United States Patent [19]

Howes et al.

[11] Patent Number: 4,671,686

[45] Date of Patent: Jun. 9, 1987

[54] PRINTER HAVING REMOVABLE PAPER FEED MODULE

[75] Inventors: James K. Howes, Matthews, N.C.; Kenneth G. Kluvo, Boca Raton, Fla.; Donald K. Rex, Highland Beach, Fla.; Graham M. White, Boca Raton, Fla.

[73] Assignee: International Business Machines Corporation, Armonk, N.Y.

[21] Appl. No.: 807,519

[22] Filed: Dec. 11, 1985

[51] Int. Cl.[4] ..... B41J 11/00

[52] U.S. Cl. ..... 400/605; 400/578; 400/611

[58] Field of Search ..... 400/605, 611, 616–616.3, 400/636, 578

[56] References Cited

U.S. PATENT DOCUMENTS

| | | | |
|---|---|---|---|
| 3,430,748 | 3/1969 | Parri | 400/636 |
| 4,058,196 | 11/1977 | Rempel | 400/616.1 |
| 4,164,376 | 8/1979 | Yarp | 400/616.1 |
| 4,269,522 | 5/1981 | Levinson et al. | 400/616.3 |
| 4,279,413 | 7/1981 | Siwik et al. | 400/636 |
| 4,347,009 | 8/1982 | Brown | 400/611 |
| 4,384,794 | 5/1983 | Okano et al. | 400/636 |
| 4,391,542 | 7/1983 | Baitz | 400/611 |
| 4,452,543 | 6/1984 | Adkisson et al. | 400/605 |
| 4,571,103 | 2/1986 | Takeo et al. | 400/616.1 |

FOREIGN PATENT DOCUMENTS

| | | | |
|---|---|---|---|
| 3421535 | 12/1984 | Fed. Rep. of Germany | 400/616 |

*Primary Examiner*—William Pieprz

*Attorney, Agent, or Firm*—Bell, Seltzer, Park & Gibson

[57] ABSTRACT

The present printer is adapted to be easily equipped with removable and interchangeable paper feed modules of several different types. Each of the paper feed modules is specifically adapted to feed a particular type of paper through the printer and each is easily replaceable by the purchaser of the printer to be used for feeding a specific type of paper therethrough. The printer is provided with a main frame including a pair of side support members and an elongate platen extends between the side support members and is fixed at opposite ends thereto. Three different types of removable and interchangeable paper feed modules are illustrated in the present application and each includes a pair of elongated end plates with a paper moving mechanism supported intermediate the elongated end plates. The end plates are each provided with a pivoted mounting member adapted to engage a guide slot in the main frame side support members and a mounting notch is provided in the midportion of each of the end plates to swing into clamping engagement with the platen when the elongated end plates are pivoted about the pivotal axis of the mounting members so that the removable paper feed module may be inserted into the working region of the printer and on the side of the platen opposite the printhead and pivoted toward the printhead to bring the clamping notch into clamping engagement with the platen.

14 Claims, 12 Drawing Figures

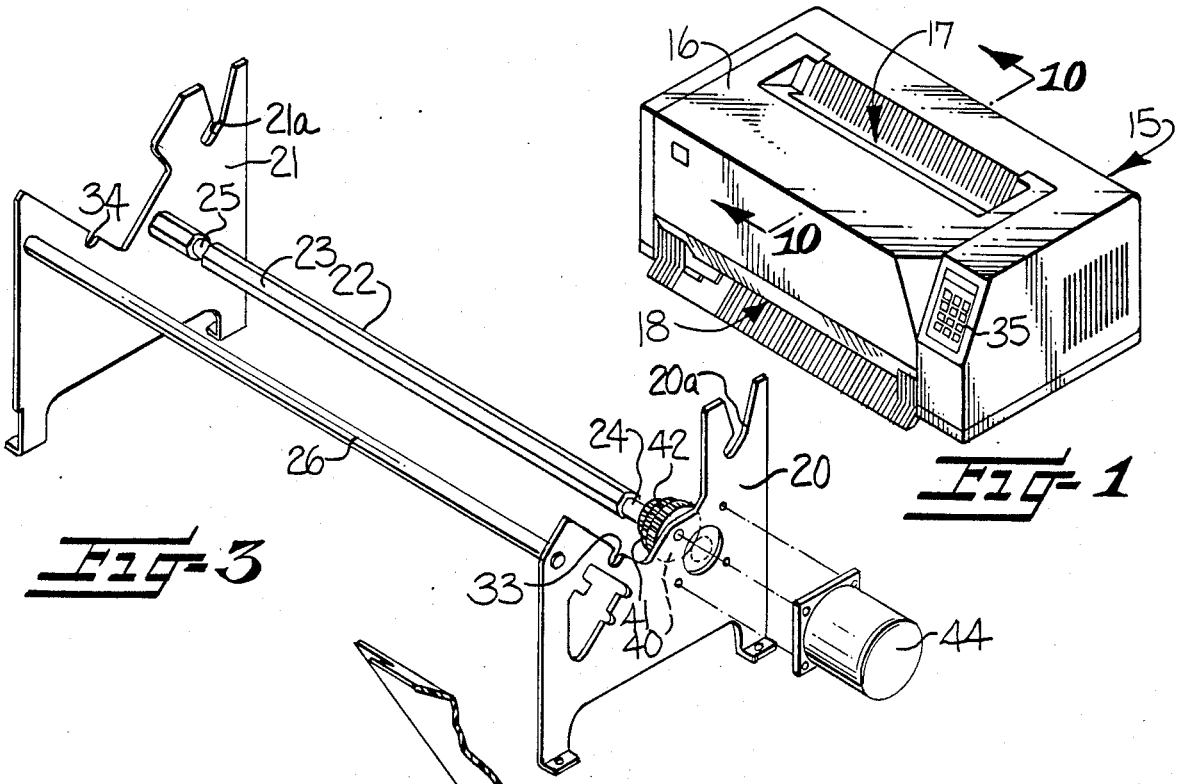
Fig-1
Fig-3
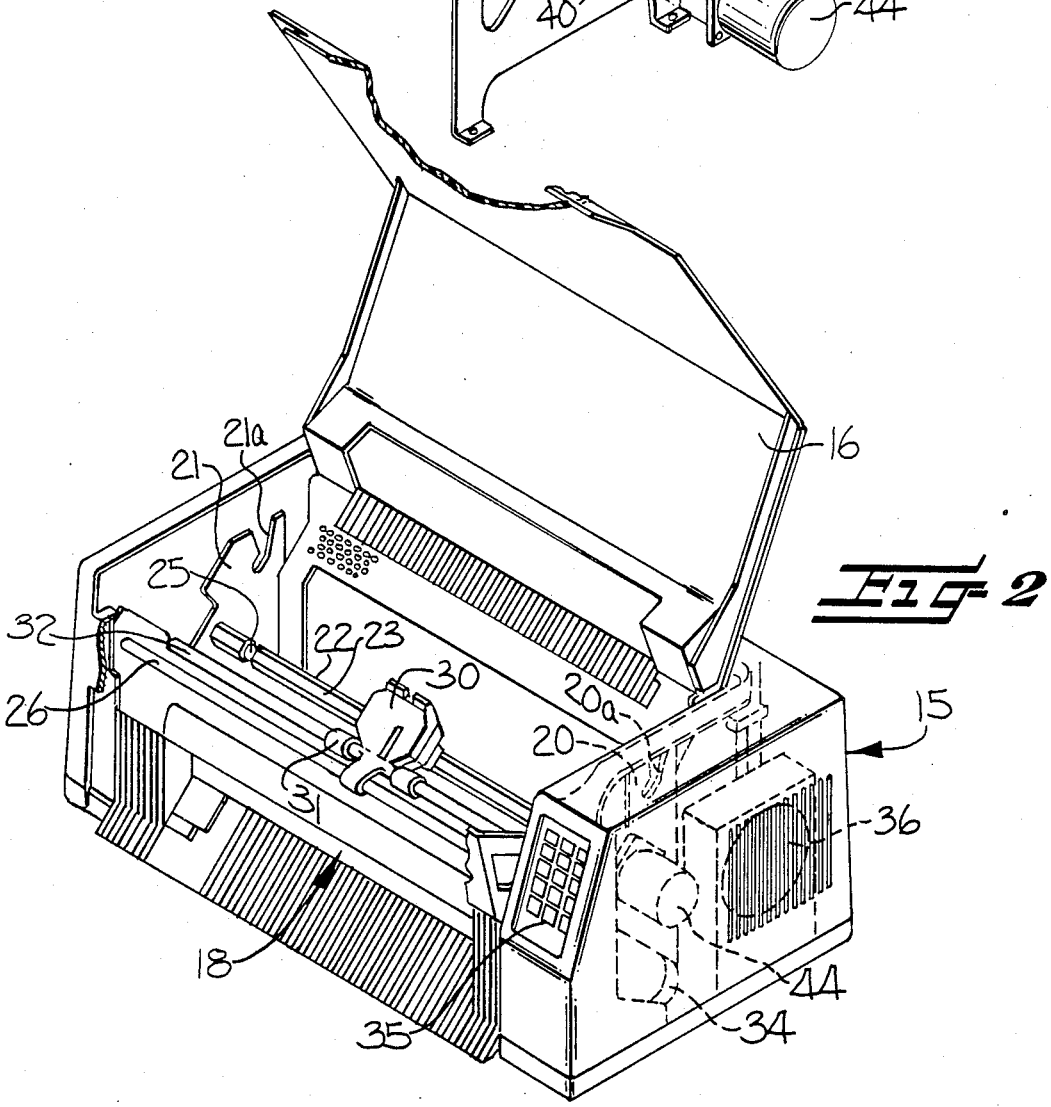
Fig-2

PRINTER HAVING REMOVABLE PAPER FEED MODULE

FIELD OF THE INVENTION

This invention relates generally to a printer having a removable paper feed module and more particularly to such a printer which is adapted to receive and support a removable paper feed module in a precise and accurate position on the platen supported in a fixed position on the main frame of the printer.

BACKGROUND OF THE INVENTION

Printers are usually manufactured with tractor or pinwheel type paper feed devices for feeding continuous form type printout paper through the printer, or with a friction roll type paper feed device for feeding cut forms, such as letterheads, individual order forms, or the like through the printer. Some printers are manufactured and sold with one type of paper feed device built into the printer and another type of paper feed device can be purchased and attached to the printer. However, the attachable or "add on" paper feed device is usually not as efficient as the paper feed device which is built into the printer and may require some mechanical skill to attach the alternate paper feed device to the printer.

Various known types of attachable paper feeding devices are shown in prior patents. For example, the printer of U.S. Pat. No. 4,341,480 is manufactured with tractors for normally feeding a continuous form type of paper through the printer. An "add on" type friction roll feed attachment is disclosed in this patent and is provided for converting the continuous form printer into a discrete sheet form printer. U.S. Pat. No. 2,355,668 is directed to a printer which is manufactured with a rotary platen normally adapted to feed cut form paper through the printer. This patent discloses a pinwheel paper feeding attachment which can be attached to the printer so that edge perforated continuous forms can be fed through the printer. U.S. Pat. No. 4,058,196 is directed to a printer with interchangerble paper feed modules, each of which includes a cylindrical platen with the paper engaging and being partially wrapped around the cylindrical platen. One of the paper feed modules includes tractor feeds and the other of the paper feed modules includes pinwheel feeds, and both of which feed edge perforated continuous forms.

While the paper feed devices disclosed in these patents do permit the feeding of various types of papers, and thereby provides the printer with greater versatility, the printer is primarily designed to feed a particular type of paper. The attachments which are provided to permit other types of paper to be fed are usually not as reliable as the paper feeding device which is built into the printer, and these alternate paper feeding attachments may cause feeding problems. Also, the paper feeds of these patents direct the paper at least partially around a cylindrical platen and this type of curved paper path can cause misalignment of multiple part forms.

SUMMARY OF THE INVENTION

With the foregoing in mind, it is an object of the present invention to provide a printer which is manufactured without a paper feeding device and is designed to be easily equipped with a removable paper feed module. The removable paper feed module is positioned in the printer in a precise location on the platen and operates to feed the paper in a substantially straight line path through the printer. Several different types of paper feed modules can be provided for easy insertion into and removal from the printer. Each of the removable and interchangeable paper feed modules is specifically designed to feed a particular type of paper through the printer. The purchaser of the printer can purchase only one type of paper feed module to be used for a specific type of paper feeding operation, or additional paper feed modules can be purchased for feeding other types of paper.

While additional types of paper feeding modules may be provided, three different types are illustrated in the present application to provide the prospective customer a wide variety of uses for the same printer. As has been pointed out above, it is known to provide a printer that will feed more than just one type of paper, but the results are often less than adequate because the alternate paper feeding devices are usually of the "add on" type with the result that it is usually necessary to compromise the "additional" paper feeding modes to the primary paper feeding mode which was originally built into the printer.

In accordance with the present invention, the printer is manufactured without any paper handling capability, but includes a paper feed drive motor and a main frame with a fixed platen for receiving and supporting the removable paper feeding module in a precise location on the platen. The paper feeding module can be easily coupled into the printer by the operator and the printer can be purchased with one or more of the paper feeding modules, depending upon the type of paper to be used therewith. While certain types of paper feed modules for feeding particular types of paper are shown in the present application, it is to be understood that the basic printer is adapted to accept various other types of paper feed modules designed for feeding a wide variety of different types of paper.

The three paper feed modules shown in the present application include a document on demand module (DOD) to be used for tear-off type edge perforated continuous forms. This type of form is normally used for retail store order forms, automobile rental forms and the like, where the printer fills in the blanks on the form, the form is rolled out the top of the machine, torn off and one copy given to the customer while one or more copies are retained. A document insertion device module (DID) is used for cut forms, such as letter size and legal size individual sheets of paper, or individual multiply forms. In this instance, the individual sheets are fed by hand into the printer one at a time. A continuous forms module (CF) is used for edge perforated computer printout type paper and is normally used in typical data processing applications.

The printer with which these removable and interchangeable paper feed modules are used includes a main frame with a pair of upstanding side support members. The side support members are maintained in spaced-apart and fixed relationship with each other by an elongate platen fixed at opposite ends to the side support members and extending across the working region of the printer intermediate the side support members. A support shaft is also fixed at opposite ends to the side members and extends across the working region parallel to the platen and supports the printhead for back and forth movement alongside the platen to provide a printing station.

The removable and interchangeable paper feed modules are each adapted to be easily inserted into and removed from the working region intermediate the main frame side support members and are precisely supported in the proper working and paper feeding position by the platen and guide slots in the side support members. The paper feed modules each includes a pair of elongated end plates with support shafts extending therebetween and maintaining the end plates in fixed relationship relative to each other and spaced apart a sufficient distance that the end plates are positioned inwardly of the main frame side support members. A mounting member is located toward one end of each of the elongated end plates for pivotal engagement with the corresponding guide slots in the side support members.

A positioning notch is provided in the midportion of each of the elongated end plates and is swingable into engagement with and partially surrounding the platen near the opposite ends thereof when the elongated end plates are pivoted about the pivotal axis of the mounting members. Clamping means is associated with the notches for clamping the elongated end plates in position on opposite end portions of the platen as the paper feed module is inserted into the working region of the printer and on the side of the platen opposite the printhead and then pivoted toward the printhead to bring the notches into clamping engagement with the platen. Paper guide means is supported intermediate the elongated end plates and both upstream and downstream of the printing station and paper feeding means is associated with the paper guide means on at least one of the upstream or downstream sides of the printing station for moving paper in a substantially straight line path across the platen and through the printing station.

The DOD paper feed module is provided with tractor feeds upstream of the printing station, friction feed rolls downstream of the printing station and spaced paper guides with a paper tear edge also downstream of the printing station. The tractor feeds and the friction feed rolls are provided with drive shafts having drive gears fixed on the ends extending through one end plate. The drive gears move into driving engagement with a drive gear supported for rotation on the platen and driven by the paper feeding drive motor built into the printer.

The DID paper feed module is provided with both paper guide plates and friction feed rolls both upstream and downstream of the printing station. The friction drive rolls are supported on drive shafts which include drive gears adjacent one of the elongated end plates. These drive gears are also adapted to drivingly mate with the paper drive gear of the printer when the paper feeding module is inserted into clamped position on the platen.

The CF paper feeding module is provided with a paper guide plate and paper tension means upstream of the printing station and tractor feeds downstream of the printing station. The tractor feeds are driven by a shaft with a drive gear on one end adjacent one of the elongated end plates. This tractor feed drive gear drivingly engages the paper drive gear of the printer when the paper feed module is in the operative position, clampingly engaged on the platen.

BRIEF DESCRIPTION OF THE DRAWINGS

Other objects and advantages will appear as the description proceeds when taken in connection with the accompanying drawings, in which FIG. 1 is an isometric view of the printer of the present invention;

FIG. 2 is an enlarged view similar to FIG. 1, but showing the access cover of the printer in a raised position and without a paper feed module therein;

FIG. 3 is an isometric view of the main frame of the printer and illustrating the side support members being maintained in fixed spaced relationship by the platen and the support shaft;

DESCRIPTION OF THE ILLUSTRATED EMBODIMENTS

Figure 10:
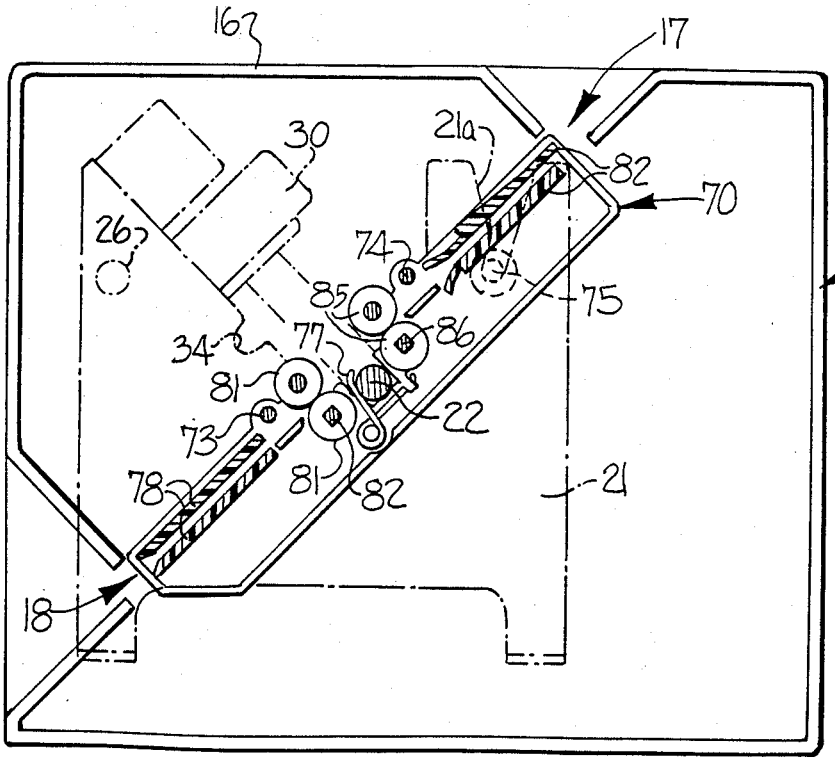
FIG. 10 is a transverse vertical sectional view taken substantially along the line 10—10 in FIG. 1 and showing the DID paper feed module in operative position for feeding individual sheets through the printer.

As shown in FIGS. 1 and 2, the printer includes an outer housing, broadly indicated at 15, and having an access cover 16 hingedly connected to the upper rear portion thereof. The hinged juncture of the cover 16 and the housing 15 provides a paper exit slot, broadly indicated at 17, and the juncture of the lower front portion of the cover 16 and an inclined surface on the housing 15 provides a paper entry slot, broadly indicated at 18, as illustrated in FIGS. 1, 2 and 10. The main frame of the printer (FIG. 3) includes a pair of upstanding side support members 20, 21 which are formed of stamped metal and the lower ends of which are suitably secured, as by vibration absorbing cushion members, not shown, to the lower base of the housing 15. An elongated platen 22 has its extremities welded in position in openings in the side support members 20, 21. The platen 22 extends across the working region of the printer and intermediate the side support members 20, 21. The platen 22 is substantially circular in cross section and has a milled flat side, indicated at 23, providing a flat printing surface over which the paper passes, in a manner to be presently described.

Circular grooves 24, 25 are provided adjacent opposite ends of the platen 22 to provide seats for clamping engagement by the paper feed modules, in a manner to be presently described. Opposite ends of a support shaft 26 are welded in position in openings in the side support members 20, 21 and, along with the platen 22, maintain the side support members 20, 21 in upstanding fixed spaced relationship to each other.

Guide slots 20*a*, 21*a* are provided in the upper rear portions of the respective side support members 20, 21 and their upper ends are provided with inwardly converging guide surfaces. As will be noted in FIG. 3, the platen 23 is in a position substantially midway between the front and rear of the side support members 20, 21. Also, the mounting guide slots 20*a*, 21*a* are positioned rearwardly and above the platen 23 and their lower portions extend forwardly toward the platen.

A printhead 30 is supported at an angle of approximately 45 degrees from the horizontal and moves back and forth alongside the platen 22. The printhead 30 is fixed to a carrier 31 supported for longitudinal movement along a printhead support shaft 32 (FIG. 2). The carrier 31 includes a forwardly extending portion engaging and being guided by the support shaft 26. Opposite end portions of the printhead support shaft 32 extend through corresponding notches or slots 33, 34 (FIG. 3) in the side support members 20, 21 and a carrier drive motor 34 (FIG. 2) is drivingly connected to the carrier 31 for moving the printhead 30 back and forth across and along the platen 22, in a conventional manner, not shown. A push button type operator panel 35 is provided in the right-hand front portion of the housing 15 for enabling the operator to enter appropriate instructions and commands to the control logic located on the printed circuit cards at the rear of the machine or printer, not shown. A cooling fan 36 is provided on the inside of the right-hand rear portion of the housing 15 for exhausting the heat generated by the motors and printhead.

Figure 12:
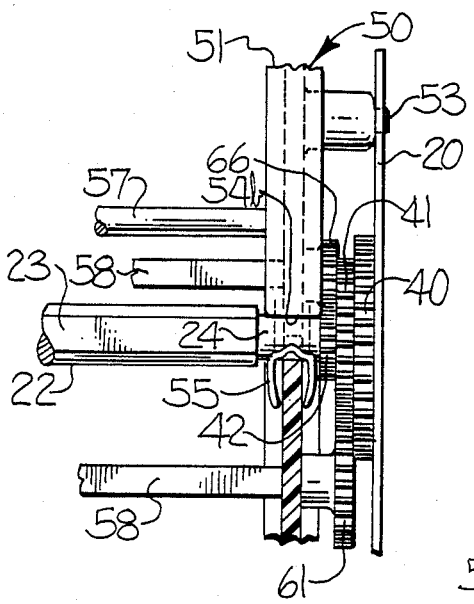
FIG. 12 is an enlarged fragmentary sectional plan view taken substantially along the line 12—12 in FIG. 11 and illustrating the manner in which the friction drive rolls and the tractors of the DOD paper feed module drivingly engage the printer drive gear when the paper feed module is in the operative position.

A so-called "triple" or compound paper drive gear is rotatably supported on the right-hand end of the platen 22 and adjacent the side support member 20 and includes a large drive gear 40, a medium tractor drive gear 41, and a small friction roll drive gear 42 (FIGS. 3 and 12). A paper drive motor 44 (FIG. 3) is mounted on the side support member 20 and has an output shaft extending inside of the side support member 20 with a drive gear, not shown, meshing with the large drive gear 40. The drive gears 41, 42 are rotated by the gear 40 and the drive motor 44 to impart rotation to the friction roll drive gears and tractor drive gears supported on the particular paper feed module placed in the printer, in a manner to be presently described.

The DOD paper feed module, broadly indicated at 50, shown in FIGS. 4, 5, 11 and 12, includes elongated end plates 51, 52 with an outwardly extending mounting member or pin 53 fixed toward one end of each of the elongated end plates. Notch means, including respective lower and rear surfaces 54*a*, 54*b*, is provided in the midportion of each of the elongated end plates 51, 52. Clamping means, illustrated in the form of a wire spring clip 55, is associated with and forms the front surface of the notch means for clamping the paper feed module in engagement with the circular grooves 24, 25 on the platen 22, in a manner to be presently described. Shaft means, illustrated as support shafts 56 and 57, is fixed at opposite ends in the end plates 51, 52 and maintains the same in spaced-apart fixed relationship to each other. The end plates 51, 52 are spaced apart a sufficient distance that the end plates are positioned inwardly of the main frame side support members 20, 21.

A fixed tractor drive assembly 59 is supported on the shaft 56 and the inner surface of the end plate 52. A drive shaft 58 is rotatably supported in the end plate 51 and the left-hand end is drivingly connected to the fixed tractor assembly 59. A movable tractor assembly 60 is supported for longitudinal movement and adjustment along the support shaft 56 and the drive shaft 58 for adjustment toward and away from the end plate 51. The right-hand end of the drive shaft 58 extends through the end plate 51 and has a drive gear 61 fixed thereon for mating engagement with the tractor drive gear 41, as illustrated in FIG. 12, when the paper feed module 50 is positioned in the printer, in a manner to be presently described.

Friction wheel drive rolls 62 are supported in a fixed position adjacent the end plate 52. An adjustment bracket 63 is fixed at its lower end to the tractor assembly 60, and its upper end is supported on the shaft 57 and has a pair of friction wheel drive rolls 64 attached thereto. The friction wheel drive rolls 62, 64 are rotated by a drive shaft 65 having a drive gear 66 fixed on the right-hand end thereof. The drive gear 66 is adapted to drivingly mate with the friction roll drive gear 42 when the paper feed module is placed in the operative position, as shown in FIG. 12. Opposite end portions of spaced-apart paper guides 67 are supported in the end plates 51, 52. The upper edge of the upper paper feed guide 67 extends upwardly beyond the lower paper feed guide and serves as a paper tear edge, indicated at 67*a*, for purposes to be presently described.

Figure 11:
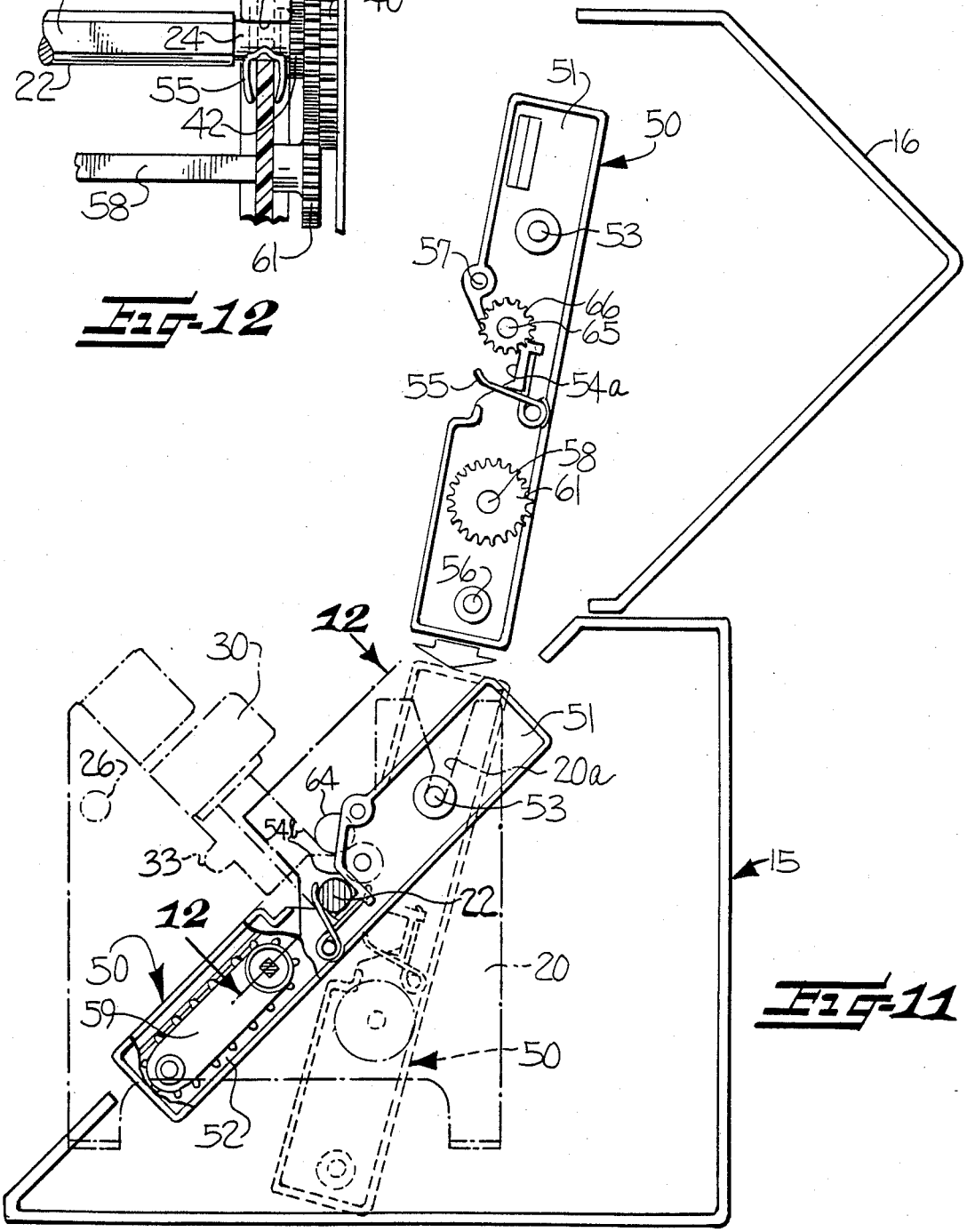
FIG. 11 is an enlarged view similar to FIG. 10, but showing the cover in a raised position and illustrating the manner in which the DOD paper feed module is inserted into the printer.

To insert the paper feed module 50 in the printer, the access cover 16 is raised, as shown in FIG. 11, and the operator holds the module 50 in substantially a vertical position and then lowers the same downwardly and rearwardly of the platen 22 so that the mounting pins 53 engage and move down into the guide slots 20*a*, 21*a* in the corresponding side support members 20, 21, to the position shown in dotted lines in FIG. 11. In this position, the weight of the paper feed module 50 is supported on the mounting pins 53 positioned in the guide and support slots 20*a*, 21*a*. The lower end of the paper feed module 50 is then pivoted forwardly and upwardly toward the printhead 30 to bring the mounting notch of each of the end members 51, 52 into engagement with the corresponding circular grooves 24, 25 adjacent opposite ends of the platen 23. The paper feeding module 50 is maintained in clamped engagement on the platen 23 by the wire clamping spring 55 so that the paper feeding module 50 is maintained in the proper feeding relationship relative to the platen 22. It will be noted in FIG. 11 that the respective lower and rear surfaces 54*a*, 54*b* (FIG. 5) of the notch provide a firm V-notch like seat for the cylindrical surface in the grooves 24, 25 of the platen 24 so that the paper path of the paper feeding module 50 is maintained in a precise relationship relative to the printing platen 22.

When the paper feed module 50 is in the operative position, the friction roll drive gear 66 is in driving engagement with the drive gear 42 and the tractor drive gear 61 is in driving engagement with the tractor drive gear 41 to impart rotation to the friction drive rolls 62, 64 and the tractor drives 57, 60, when the paper feed drive motor 44 is rotated. With the paper feeding module 50 in the operative position, as shown in FIG. 11, paper guide means is provided intermediate the elongate end plates 51, 52 and both upstream and downstream of the printing station, provided by the printhead 30 and the platen 22. The paper guide means upstream of the printing station is provided by the tractor drives 57, 60, while the paper guide means downstream of the printing station is provided by the friction wheel drive rolls 62, 64 and the guide plates 67.

The DOD paper feed module 50 is fed with continuous form edge perforated paper by directing the leading end inwardly through the inlet opening 18 so that the side perforations are engaged by the tractors 57, 60 to move the same through the printing station and over the platen 22. The paper is then guided between the friction wheel drive rolls 62, 64 and between the guide plates 67. After the desired printing is formed on the tear-off form, the paper is advanced so that the perforation line along the tear-off edge is positioned in alignment with the paper tear edge 67*a* on the upper edge of the upper guide 67. The printed form is then torn off and removed. The motor 44 is reversed to move the printed form downwardly so that printing can be carried out adjacent the top of the next form. As the direction of rotation of the motor 44 is reversed, the friction drive rolls 62, 64 and the tractors 57, 60 draw the continuous form paper downwardly through the printing station to the desired location to begin printing of the next form.

To remove the DOD paper feeding module 50, it is merely necessary to remove the paper and pivotally move the lower end of the module 50 inwardly and downwardly to remove the notches from engagement with the platen 22, so that the module 50 is in substantially the dotted line position shown in FIG. 11. In this position, the weight of the module 50 is supported by the mounting pins 53 in pivotal engagement with the slots 20*a*, 21*a*. The feeding module 50 can then be raised in a vertical direction removing the mounting pins 53 from the corresponding grooves or slots 20*a* and 21*a* in the respective side support members 20, 21.

Figure 4:
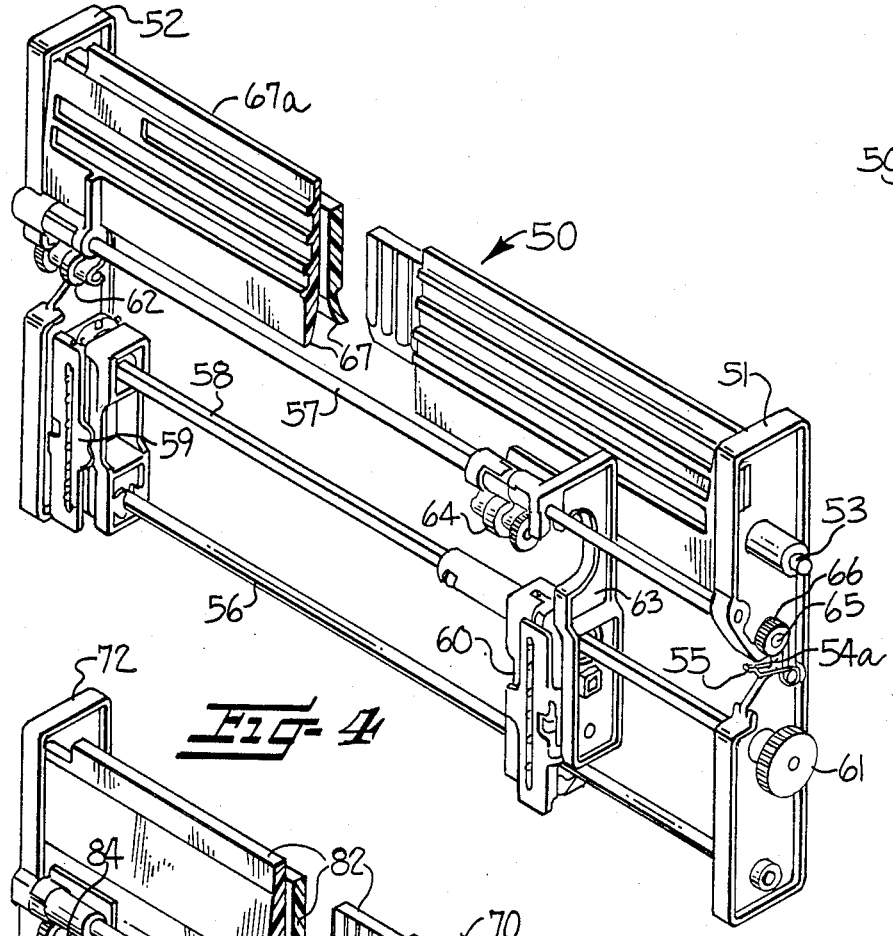
FIG. 4 is an isometric view of the DOD paper feed module with a medial portion of the paper guide broken away for purposes of clarity.
Figure 5:
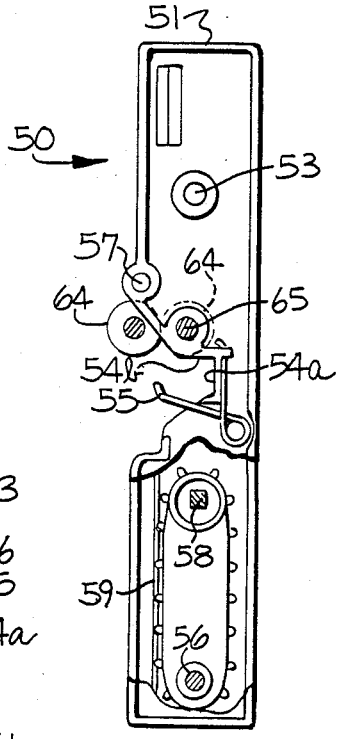
FIG. 5 is an enlarged end elevation of the DOD paper feed module shown in FIG. 4, with parts broken away.
Figure 6:
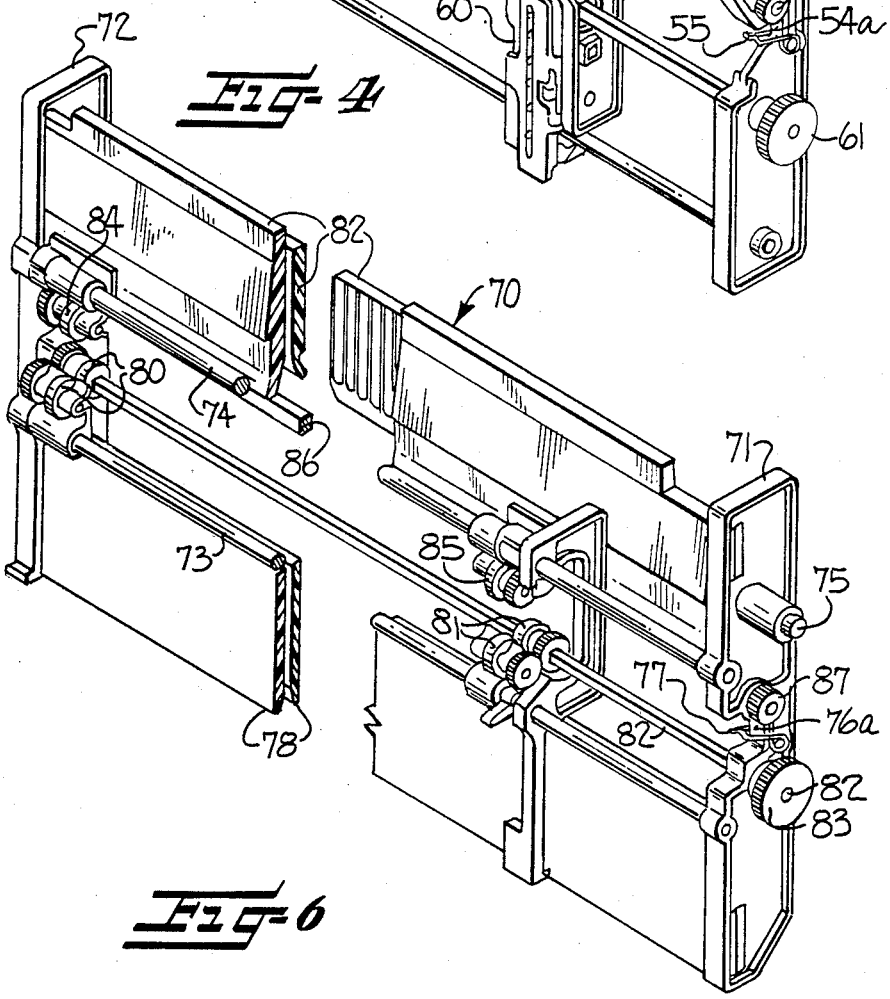
FIG. 6 is an isometric view similar to FIG. 4, but illustrating the DID paper feed module.
Figure 7:
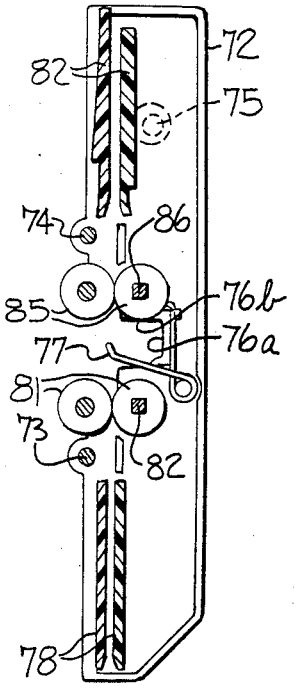
FIG. 7 is an enlarged vertical sectional view of the DID paper feed module shown in FIG. 6.

The DID paper feed module, broadly indicated at 70 in FIGS. 6, 7 and 10, includes elongated end plates 71, 72. Opposite ends of support shafts 73, 74 are fixed in the end plates 71, 72 and maintain the same in fixed relationship relative to each other. The end plates 71, 72 are spaced apart a sufficient distance that they are positioned inwardly of the main frame side support members 20, 21 when positioned in the paper feeding position, in a manner to be presently described. Each of the end plates 71, 72 is provided with an outwardly extending mounting member, in the form of a mounting pin 75, located toward one end of each of the end plates 71, 72. A mounting notch, including respective lower and rear surfaces 76*a*, 76*b*, is provided in each of the end plates 71, 72 and in the midportion thereof, and a wire clamping spring 77 is associated with each of the mounting notches for clamping engagement with the corresponding circular grooves 24, 25 on opposite end portions of the platen 22. The surfaces 76*a*, 76*b* provide a firm V-notch like seat for precise positioning of the module 70 on the platen 22.

The paper feeding module 70 is provided with paper guide means supported intermediate the end plates 71, 72 and both upstream and downstream of the printing station. The upstream paper guide means includes a pair of paper guides 78 supported at opposite ends on the end plates 71, 72 and fixed friction drive rolls 80 supported in fixed position adjacent the end plate 72. Friction drive rolls 81 are provided adjacent the right-hand end plate 71 and are longitudinally adjustable along the support shaft 73 and driven by a drive shaft 82. The right-hand end of the drive shaft 82 is rotatably supported in and extends outwardly beyond the end plate 71 and has a drive gear 83 fixed thereto.

The paper feeding module 70 is provided with guide means on the downstream side of the printing station, including friction drive rolls 84 fixed adjacent the end frame 72 and longitudinally adjustable friction drive rolls 85 supported for longitudinal adjustment on the support shaft 74. A drive shaft 86 is drivingly connected to the friction drive rolls 84, 85 and the right-hand end thereof is rotatably supported in and extends outwardly beyond the end plate 71 and is provided with a drive gear 87. The downstream paper guide means also includes a pair of spaced-apart guide plates 88 having opposite ends supported in the end plates 71, 72.

The paper feed module 70 is positioned in the operative position in the printer in the same manner as has been described for the insertion of and removal of the paper feed module 50. When positioned in the paper feeding position, as shown in FIG. 10, the DID paper feed module 70 is adapted to receive and feed individual forms or sheets of paper through the printer and across the platen 22 in a substantially straight line path of travel. The leading edge of the paper is manually inserted through the inlet slot 18 and between the guide plates 78. The friction rolls 80, 81 and 84, 85 are then rotated so that the paper feeds upwardly at a 45 degree angle through the printing station and between the exit guide plates 82. Thus, the individual sheets of paper or forms are frictionally gripped by the friction drive rolls both upstream and downstream of the printing station and the paper guides provide paper guide means both upstream and downstream of the printing station.

Figure 8:
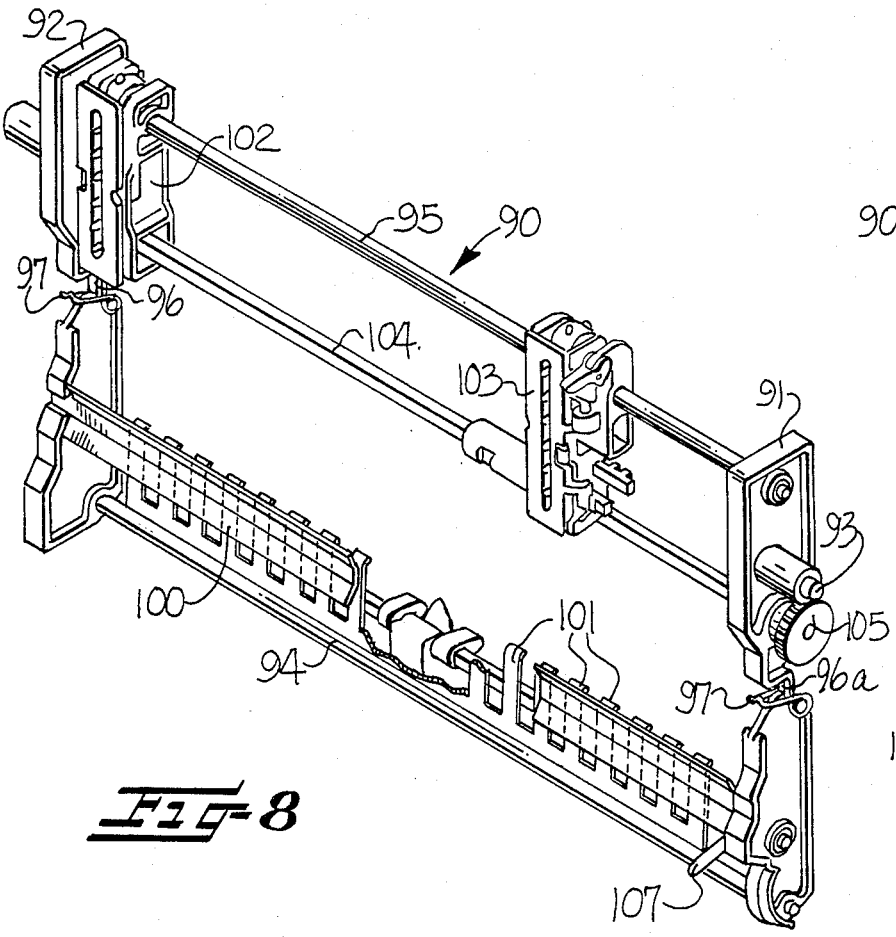
FIG. 8 is an isometric view of the CF paper feed module.
Figure 9:
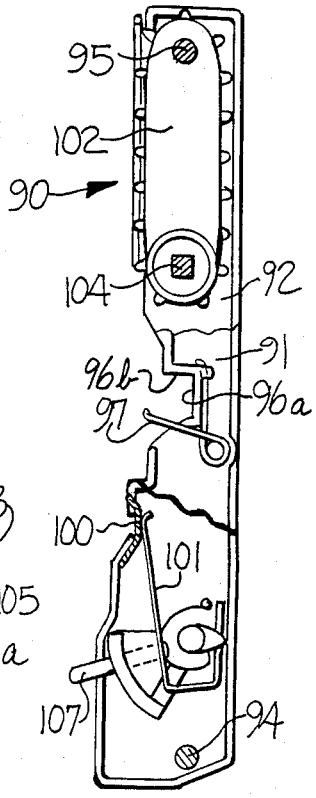
FIG. 9 is an enlarged end elevation of the CF paper feed module shown in FIG. 8, with parts broken away.

The CF paper feed module, broadly indicated at 90 in FIGS. 8 and 9, includes elongated end plates 91, 92, each of which is provided with a mounting pin or post 93 located toward one end thereof and extending outwardly therefrom for pivotal engagement with the guide slots 20*a*, 21*a* in the main frame side support members 20, 21. Opposite ends of lower and upper support shafts 94, 95 are fixed in the end plates 91, 92 and maintain the end plates in fixed relationship relative to each other. The end plates 91, 92 are spaced apart a sufficient distance that the end plates 91, 92 are positioned inwardly of the main frame side support members 20, 21 when the paper feed module 90 is in the active position in the printer. Each of the end frames 91, 92 is provided with a mounting notch in the midportion thereof. The mounting notch includes respective lower and rear surfaces 96*a*, 96*b*, providing a firm V-notch like seat for precise positioning of the module 90 on the platen 22. The mounting notch is properly positioned to be swingable into engagement with and to partially surround the circular grooves 24, 25 of the platen 22. A wire clamping spring 97 is associated with each of the positioning notches for clamping the end plates 91, 92 into engagement with the corresponding grooves 24, 25 of the platen 22. The wire clamping spring 97 forms the front wall or surface of the mounting notch and maintains the lower and rear seating surfaces or walls 96*a*, 96*b* of the mounting notch in firm and precise engagement with the grooves 24, 25 of the platen 22.

Paper guide means, in the form of a drag tension plate 100 and paper tension spring fingers 101, is provided adjacent the lower end of the end plates 91, 92 and upstream of the printing station. A tractor drive assembly 102 is fixed adjacent the end plate 92 and a longitudinally adjustable tractor drive assembly 103 is supported at its upper end for longitudinal adjustment on the support shaft 94 and adjacent the end plate 91. The tractor drive assemblies 102, 103 are driven by a drive shaft 104, the right-hand end of which is rotatably supported in and extends through the end plate 91 and has a drive gear 105 fixed thereto.

The CF paper feed module 90 is inserted and removed from the printer in the same manner as the DOD paper feed module 50 and the DID paper feed module 70. When the CF paper feed module 90 is in the operative position, the drive gear 105 engages the tractor drive gear 41 and the tractor feed assemblies 102, 103 are rotated when the drive motor 44 is actuated.

When the CF paper feed module 90 is positioned in the printer, the continuous form paper is fed through the tension device downstream of the printing station and engaged with the tractor feed assemblies 102, 103 upstream of the printing station so that the paper passes between the platen 22 and the printhead 30. The tension placed on the continuous form paper may be adjusted by the tension fingers 101 which are pressed to a greater or lesser extent against the paper by the position of a control handle 107.

Thus, each of the removable and interchangeable paper feed modules 50, 70 and 90 is adapted to be easily inserted into and removed from the working region intermediate the main frame side support members 20, 21. Each of the removable paper feed modules includes elongated end plates with support means extending between and maintaining the elongated end plates in fixed relationship relative to each other and spaced apart a sufficient distance that the end plates are positioned inwardly of the main frame side support members. An outwardly extending mounting member is located toward one end of each of the elongated end plates for pivotal engagement with guide slots in the main frame side support members and a locating notch is positioned in the midpoint of each of the elongated end plates so that the notch is swingable into engagement with and partially surrounds the platen near opposite ends thereof when the elongate end plates are pivoted about the pivotal axis of the mounting members. While the element on each of the paper feed modules for precisely locating and positioning the paper feed module on the platen is shown as a locating notch on the midpoint of each of the elongated end plates, it is to be understood that the locating elements could comprise other suitable arrangements having either fixed or adjustable surfaces engageable with the platen for accurately positioning the paper feed module relative to the platen.

Clamping means is associated with the notch means for clamping the elongated end plates to the platen so that the removable paper feed module may be inserted into the working region of the printer on the side of the platen opposite the printhead and pivoted toward the printhead to bring the mounting notch into clamping engagement with the platen to provide a precise positioning of the paper feed module relative to the platen. Paper guide means is supported intermediate the end plates and both upstream and downstream of the printing station. The paper guide means can be in the form of paper feeding means and/or paper guide plates and with the paper feeding means being on at least one of the upstream or downstream sides of the printing station for moving the paper across the platen and through the printing station.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. A printer with a plurality of interchangeable paper feed modules, said printer including a main frame comprising:

a pair of upstanding side support members, an elongated platen having its extremities attached to said side support members and extending across the working region of the printer intermediate said side support members, shaft means supported by said side support members and extending across the working region parallel to said platen for aiding in supporting said side support members, and printhead means movably supported by said shaft means for moving along a path back and forth alongside said platen, each of said interchangeable paper feed modules being adapted to be easily inserted into and removed from the working region intermediate said main frame side support members, each of said interchangeable paper feed modules including:

a pair of elongated and substantially straight end plates extending both upstream and downstream of said platen;

a paper moving mechanism supported intermediate said elongated end plates and including paper guiding and feeding means on both upstream and downstream sides of said platen;

a mounting member located toward one end of each of said end plates for pivotal engagement with the corresponding main frame side support member;

notch means associated with said paper feed module and postioned in the midportion thereof and adapted to swing into engagement with and partially surround said platen when said elongated end plates are pivoted about the pivotal axes of said mounting members; and clamping means associated with said notch means for clamping said paper feed module to said platen, whereby a selected one of said interchangeable paper feed modules may be inserted into the working region of the printer on the side of said platen opposite said printhead means and pivoted toward said printhead means to bring said notch means into clamping engagement with said platen and said paper moving mechanism into alignment with said platen for enabling the feeding of paper across said platen on the printhead side thereof.

2. A printer according to claim 1 wherein said printer includes a substantially rectangular housing enclosing said printhead means and said main frame side support members, and wherein said housing includes a paper entrance slot in the lower front portion thereof and a paper exit slot adjacent the rear upper portion thereof so that paper fed through the printer follows a substantially straight line path into and out of said housing and through said printing station.

3. A printer according to claim 1 wherein said printhead means is supported at an angle of approximately 45 degrees relative to the horizontal, and wherein said elongated end plates are supported perpendicular to the path of movement of said printhead means and also at an angle of approximately 45 degrees relative to the horizontal.

4. A printer according to claim 1 including gear means rotatably supported on said platen and adjacent one of said side support members for imparting movement to said paper moving mechanism, drive motor means supported on said one side support member and being drivingly connected to said gear means, and gear means drivingly connected to said paper moving mechanism of each of said paper feed modules and positioned adjacent one of said end plates to drivingly engage said gear means on said platen when a selected one of said interchangeable paper feed modules is inserted into the working region of the printer and into clamping engagement with said platen.

5. A printer according to claim 4 wherein said gear means on said platen comprises a compound gear adapted to be engaged by said gear means on said paper feed modules for driving different type of paper moving mechanisms carried by said interchangeable paper feed modules.

6. A printer according to claim 5 wherein said compound gear includes three interconnected gears, and wherein one of said gears is drivingly connected to said drive motor, the other two of said gears being adapted to be drivingly connected to different types of paper moving mechanisms carried by said interchangeable paper feed modules.

7. A removable paper feed module for use with a printer having a main frame including a pair of side support members, an elongated platen having its extremities attached to said side support members and extending across the working region of the printer intermediate said side support members, shaft means supported by said side support members and extending across the working region parallel to said platen for aiding in supporting said side support members, and printhead means movably supported by said shaft means for moving along a path back and forth alongside said platen, said removable paper feed module being adapted to be inserted into the working region intermediate said main frame side support members, said removable paper feed module comprising:

a pair of elongated and substantially straight end plates extending both upstream and downstream of said platen;

a paper moving mechanism supported intermediate said elongated end plates and including paper guiding and feeding means on both upstream and downstream sides of said platen;

each elongated end plate including a mounting member located toward one end thereof for pivotal engagement with the corresponding main frame side support member;

and each elongated end plate also including notch means in the midportion thereof which swings into engagement with and partially surrounds said platen near an exteremity thereof when said elongated end plates are pivoted about the pivotal axes of said mounting members; and said notch means including clamping means for clamping said elongated end plates to said platen, whereby said removable paper feed module may be inserted into the working region of the printer on the side of said platen opposite said printhead means and pivoted toward said printhead means to bring said notch means of said elongated end plates into clamping engagement with said platen and said paper moving mechanism into alignment with said platen for enabling the feeding of paper across said platen on the printhead side thereof.

8. A removable paper feed module according to claim 7 particularly adapted for feeding individual paper in a document insertion mode and including friction wheel drive means supported on said module and positioned both downstream and upstream of said platen, and paper guide means supported on said module and positioned both downstream and upstream of said platen.

9. A removable paper feed module according to claim 7 particularly adapted for feeding continuous form paper in a continuous mode and including paper tension means supported on said module and positioned upstream of said platen, and tractor drive means supported on said module and positioned downstream of said platen.

10. A printer in combination with a plurality of removable paper feed modules, said printer including a main frame comprising:

a pair of upstanding side support members, an elongated platen having its extremities supported by said side support members and extending across the working region of the printer intermediate said side support members, printhead means movably supported for moving along a path back and forth alongside said platen, said platen and said printhead means defining a printing station through which the paper passes, each of said removable paper feed modules being adapted to be easily inserted into and removed from the working region intermediate said main frame side support members, each of said removable paper feed modules including:

a pair of elongated and substantially straight end plates extending both upstream and downstream of said platen;

support means extending between and maintaining said elongated end plates in fixed relationship relative to each other and spaced apart a sufficient distance that said end plates are positioned inwardly of said main frame side support members;

a mounting member located toward one end of each of said elongated end plates for pivotal engagement with the corresponding main frame side support member;

notch means in the midportion of each of said elongated end plates, said notch means being swingable into engagement with and partially surrounding said platen near an extremity thereof when said elongated end plates are pivoted about the pivotal axes of said mounting members, clamping means associated with said notch means for clamping said elongated end plates to said platen so that said removable paper feed module may be inserted into the working region of the printer on the side of said platen opposite said printhead means and pivoted toward said printhead means to bring said notch means of said elongated end plates into clamping engagement with said platen, and paper guide means supported intermediate said elongated end plates and both upstream and downstream of said printing station, and paper feeding means associated with said paper guide means on at least one of the upstream or downstream sides of said printing station for moving paper across said platen and through said printing station.

11. A printer according to claim 10 including a paper feed module mounting slot in each of said side support members, said mounting slots adapted to receive said mounting members and guide the same into position for pivotal movememnt of said paper feed module into paper feeding position.

12. A printer according to claim 11 wherein said mounting members each comprise a mounting pin fixed to a corresponding end plate and extending outwardly therefrom.

13. A printer according to claim 12 wherein said platen is supported in a position substnatially midway between the front and rear of said side support members, and wherein said mounting slots are positioned rearwardly and above said platen.

14. A printer according to claim 13 wherein said mounting slots extend downward and forwardly in said side support members and toward said platen.

* * * * *